United States Patent [19]

Sivachenko

[11] 4,291,510

[45] Sep. 29, 1981

[54] PREFABRICATED BUILDING CONSTRUCTION

[76] Inventor: Eugene W. Sivachenko, 6471 Riverside Dr., Redding, Calif. 96001

[21] Appl. No.: 860,797

[22] Filed: Dec. 15, 1977

[51] Int. Cl.[3] ..... E04B 7/00

[52] U.S. Cl. ..... 52/90; 52/22; 52/94; 52/274; 52/284; 52/295; 52/795

[58] Field of Search ..... 52/94, 90, 86, 630, 52/800, 799, 22, 45, 53, 795, 274, 284, 295

[56] References Cited

U.S. PATENT DOCUMENTS

| | | | |
|---|---|---|---|
| 1,983,828 | 12/1934 | Wise | 52/86 |
| 2,330,819 | 10/1943 | Faure | 52/90 |
| 2,333,343 | 11/1943 | Sendzimir | 52/799 |
| 3,540,171 | 11/1970 | Kumnick | 52/86 |
| 3,820,295 | 6/1974 | Folley | 52/630 |
| 4,099,359 | 7/1978 | Sivachenko | 52/630 |

FOREIGN PATENT DOCUMENTS

| | | | |
|---|---|---|---|
| 214576 | 7/1956 | Australia | 52/90 |
| 1296912 | 5/1962 | France | 52/90 |
| 1110259 | 10/1965 | United Kingdom | 52/22 |

*Primary Examiner*—John E. Murtagh
*Attorney, Agent, or Firm*—Townsend and Townsend

[57] ABSTRACT

A building constructed of corrugated sheet metal panels defining upright side walls, a roof and a connector for securing the roof to the side walls. The connector is a part of or integrally constructed with the side wall, has the same corrugations as the side wall, and is curved or bent inwardly towards the center of the building. The roof is secured to the inwardly directed end of the connector and the connector forms the sole support and force transmitting member between the roof and the side wall so that substantially the full space enclosed by the side walls and the roof is unobstructed. The side walls and the roof are constructed of multiple panels secured to each other and end walls attached to ends of the side walls and the roof complete the enclosure of the interior space. Also disclosed is a method for forming or bend the connector as well as for forming a curved crown portion of the roof.

13 Claims, 30 Drawing Figures

PREFABRICATED BUILDING CONSTRUCTION

BACKGROUND OF THE INVENTION

Today's skyrocketing building costs have caused many attempts to reduce the costs through the use of prefabricated modules or building sections, the use of more efficient materials and construction techniques, and design improvements which maximize the enclosed building space for the money expended on it. In the past, attempts have been made to reduce the cost of industrial type buildings by constructing them of corrugated sheets, usually metal sheets. Initially, the corrugated sheet was applied to a load carrying structure of columns, beams and purlins. Later on, the corrugated sheets have been utilized as load carrying members.

U.S. Pat. No. 3,492,765 illustrates one of the more recent approaches in that direction. According to that patent a corrugated metal building is constructed by forming corrugated sheet into load carrying, spaced apart upright walls and attaching thereto an inclined roof, also constructed of corrugated sheet. The joint between the roof and the upright wall is a miter joint incapable of supporting any load, a fact that is common to almost all prior art buildings.

To form a structurally sound roof-to-wall connection the referred to patent uses a supporting truss which is interposed between the inside of the roof and the inside of an upper region of the side wall. This truss transfers the weight and other loads carried by the roof to the side walls without stressing the mitered joint. This results in stress concentrations in both the roof and the side walls at the point at which the truss is attached to them, a highly undesirable characteristics of this as well as of all other prior art building employing a supporting frame structure. To reduce the stress concentrations, the reference patent suggests to install load equalizing plates which are secured to the portion of the wall and the roof at which the truss is attached.

Although the building disclosed in the discussed U.S. patent is a significant improvement over other prior art building constructions, particular corrugated building constructions, it has drawbacks. It is relatively complicated to build, requires a careful joining of the mitered ends of the upper side wall end and the lateral roof end, requires the manufacture of the trusses and of the load equalizing plates, and further requires their separate installations. All of this is time consuming and renders the building more costly. In addition, the truss disposed inwardly of both the side walls and the roof takes up interior, enclosed building space which could otherwise be utilized.

Other prior art building constructions use a variety of means such as beams, columns, purlins, or rafters, or a combination thereof, to adequately support and secure the building roof to the building side walls. U.S. Pat. No. 3,308,596 is illustrative of such attempts. In all instances, the manufacturing, installation and maintenance costs are relatively high and, additionally, costly enclosed space is rendered unusable.

SUMMARY OF THE INVENTION

The present inventions provides an improved building structure which eliminates some of the shortcomings of prior art buildings discussed above. Generally speaking, a building constructed in accordance with the present invention comprises the conventional spaced apart, parallel building walls spanned by a roof. The roof-to-building wall connection, however, is defined by a connector constructed of corrugated sheet which spans the length of the building and which is curved in the direction of the sheet corrugations. One end of the connector is connected with the building wall while the other end of the connector is connected with the building roof so that the corrugated sheet connector forms the weight carrying and force transmitting member between the roof and the wall.

This construction of the building wall-to-roof connection, and the absence of a wall/roof panel supporting frame structure eliminates the earlier discussed stress concentrations. Accordingly, a building constructed in accordance with this invention is capable of more efficiently and safely withstanding wind or earthquake forces than comparable prior art buildings.

It is preferred that each building wall be constructed of a plurality of relatively narrow, substantially aligned and interconnected wall panels, each panel comprising a corrugated plate having corrugations that are dimensioned to be complementary to the corrugations of the connector. It is further preferred that the connector be integrally constructed with and that it define the upper end of the wall panels. The lower end of the walls is secured to a building foundation; in a preferred embodiment of the invention by extending the wall into the foundation.

The building roof is also constructed of corrugated, relatively narrow panels, each panel having the same corrugations as the connectors and the wall panel. The roof panel is normally defined by two inclined panel sections that slope downwardly from a curved roof crown to the point of connection with the curved wall connector.

Once the wall panels are anchored to the foundation and the roof panels are secured, e.g. bolted to the curved connector, the building is structurally fully erected and self-supporting. It will be observed that this is accomplished without the need for complex, interior support members such as columns, beams, purlins, rafters or similar framing. It is further accomplished without the need for inwardly projecting trusses or load equalization plates. Accordingly, a building constructed in accordance with the present invention has an interior, enclosed space that is fully usable and unobstructed.

To fully enclose the interior of the building, end walls are erected, the lower ends of which are also anchored to the foundation. The upper regions of the end walls are connected with the wall and roof panels so as to transfer horizontal forces (such as wind forces) to the wall panels. Preferably, this is done by providing generally horizontally oriented load transferring beams or stringers which are suitably secured to the end walls and to the roof panel, the connector and/or the wall panels for the transfer of horizontal end wall forces to the roof and thence to the wall, or to the wall directly. To distribute such horizontal forces over a number of wall panels and to prevent an undue stressing of a single panel, the stringer preferably extends over the length of a plurality of wall panels. In many instances, however, it has a length less than the full building length.

A further advantage provided by the present invention is the fact that the erected building can readily be lengthened by simply unbolting the end walls, bolting additional side walls and roof panels to the already existing building, and thereafter bolting the previously removed end wall to the newly erected panels. In contrast thereto, prior art structures require the difficult and time-consuming removal of the end wall, of end wall supporting stanchions and of similar structural members before the building can be lengthened. The re-erection of the end wall is similarly complicated and time-consuming.

By constructing the building of corrugated sheet metal having relatively long and deep corrugations, such as a corrugation pitch of at least about 9 inches, and preferably of no less than 16 inches and a corrugation depth of at least about 3 inches, preferably of no less than about 5½ inches, an industrial type building having a width of 80 feet or more, a height of as much as 25 feet and any desired length can be constructed in the above-described manner utilizing 14 gauge galvanized sheet steel. A building constructed in accordance with the present invention may be as much as 30% heavier than prior art buildings of a comparable size. However, it can be constructed of only a few different parts or modules by simply bolting together the required number of such modules to erect a building of the desired size. Thus, the invention greatly reduces manufacturing, inventory, assembly and erection costs so that the overall costs of the building, as compared to prior art buildings, is reduced by 20 to 40% inspite of the fact that its weight is greater than that of prior art buildings. The greater wall thickness lends itself much more readily to a portable (as well as permanent) building which can be readily erected and dismantled with much less chance of being damaged because of the heavier thickness of the skin and much less pieces to handle. Moreover, the present invention yields a building with a substantially improved, e.g. a substantially greater usable enclosed space for a given building size.

An added advantage gained from constructing the panels of relatively thick plate, e.g. 14 gauge steel plate, is the fact that such plates are much less susceptible to damage during handling as compared to metal skin applied to a building supporting frame. Consequently, a portable building constructed according to the present invention has a longer service life than comparable prior art buildings and remains aesthetically more attractive, that is it does not look used, dented or damaged shortly after it has been placed in use.

The building and in particular the building modules can be mass produced, shipped to the construction site and there they are quickly erected by simply bolting (or otherwise fastening) together the relatively small and readily handled building wall panels and roof panels. Since the modules are relatively light (a 20 ft.×32" wall panel can weigh as little as about 200 lbs.) this can be accomplished manually or with only minimal hoisting equipment such as fork lifts, resulting in a significant saving of time as compared to erection times for prior art buildings of a comparable size.

One of the keys to the relatively low cost of a building constructed in accordance with the present invention and the short erection times is the fact that the structural portion of the building can be made up of no more than two building modules, to wit the wall panels and the roof panels. This greatly reduces assembly and installation work as well as needed inventories. This is accomplished by virtue of the fact that all structural elements of the building are simultaneously employed as an enclosure for the interior building space and as a structural element, that is as members subjected to stress. The heretofore, unstressed building portions, such as siding applied to building columns and beams, or unstressed joints between the building wall and the roof, as disclosed in the above-discussed U.S. patent, are eliminated. Thus, one may summarize that a building constructed in accordance with the present invention utilizes the materials used for the building in the most efficient way, that is utilizes the material simultaneously as enclosure materials and load bearing members.

Another important aspect of the present invention to reduce the overall costs of the building is the proper selection and dimensioning of the modules so as to minimize the number of different modules and the number of fasteners for interconnecting the modules while maximizing the square foot coverage of the panels. Accordingly, the side wall panels as well as the roof panels are made symmetric about their longitudinal center lines (which run parallel to the corrugations) to avoid the need for lefthand and righthand panels, particularly wall panels which are integrally constructed with the curved wall-to-roof connectors. When so constructed the bulk of the building side walls and roof can be constructed of only one type of side wall panel and one type of roof panel. To render the side wall and roof ends symmetric and to facilitate the installation of building end walls, it is preferred to add on one end of each side wall and the roof a second, normally narrower panel as is more fully described below.

The building erection and assembly is facilitated by locating panel side lap connecting bolts at the sloped portion of the corrugated sheets, that is in the vicinity of the neutral axis thereof. Bolt stresses are thereby minimized so that smaller diameter bolts can be utilized. Moreover, when so located the bolts do not protrude beyond the building wall which enhances the appearance of the building and renders the enclosed space unobstructed by protruding bolts or other fasteners. Furthermore, to facilitate the nesting of the panels and to enhance the quality of the joints between them, particularly where the curved connectors are secured to the roof panels, the corrugations are preferably formed so that one of the peaks and the valleys of the panel is wider than the other by an approximate material thickness, say by 3/16". As a result, the corrugations and therewith the panels become truly nesting which enhances the quality of the joint by providing for a better seal of the interior building space while it also reduces storage and shipping space.

Lastly, in the presently preferred embodiment of the invention the corrugation pitch is approximately 16" and the corrugation depth is approximately 5½" with a generally trapezoid profile. As compared to the corrugations disclosed in the earlier mentioned U.S. Pat. No. 3,308,956 this gives the corrugated panel of the present invention greater strength than that disclosed in the patent even when the two are made of the same material. Additionally, the panel of the present invention is relatively wider, that is it provides for an approximately 6–7% greater coverage. Moreover, the much simpler profile of the corrugations of the present invention made it possible to corrugate the panel from steel plate having a yield strength of as much as 50,000 psi without cracking, rupturing, etc. the steel while the intricate corrugations of the reference patent must be made of steel having a yield strength of no more than 33,000 psi to avoid cracking of the plate while it is being corrugated. As a result, by selecting higher strength steel plate, the present invention achieves more than a 50% increase in the strength of the plate while the increase in the cost of the steel plate is only about 2%. In addition, the favorable deep corrugation form of the present invention itself renders the present invention more than five times as efficient as corresponding prior art products.

Another important aspect of the present invention relates to the manner of constructing the building and in particular the manner of constructing the building modules so that they can be employed in the just discussed manner. Accordingly, the present invention provides a method for erecting the relatively lightweight, low cost building of the present invention by prefabricating the building modules and only assembling them at the construction site. Speaking in general terms, the method comprises the steps of forming a plurality of wall panels, each panel having a length parallel to the undulations which normally exceeds its width and forming a plurality of roof panels having undulations complementary to the wall panel undulations and defining a pair of integrally constructed, angularly inclined roof panel sections joined by a roof panel center portion.

Initially, suitably located and distributed bolt, rivet and the likes holes are punched, drilled or otherwise formed in the panels.

The method further includes the steps of inclining the roof panel sections with respect to each other to form a curved roof panel crown and forming a curved roof panel-to-wall panel connector in an upper region of each wall panel. Each such forming step preferably includes the steps of incrementally curving a portion of the corresponding panel about an axis that is perpendicular to the undulations of such panel.

In accordance with one embodiment of the invention the actual forming of the curved panel sections is done by furnishing a pair of opposite, complementary concave and convex forming dies which have a profile that corresponds to the profile of the panel undulations. The dies have a curved length with a curvature radius corresponding to the desired curvature radius of the curved panel portions, the curved die length extending over an arc which is substantially less than, and normally only a fraction of the desired arc length of at least one of the roof panel sections and the upper region of the wall panels. The respective panels are placed between the dies, thereafter the dies are forced against each other to flow-form and curve the panels, the dies are then moved apart and the panels are advanced in a direction parallel to the undulations by a distance no greater than the curved die length. Thereafter, the steps of forcing the dies against each other, moving them apart and again advancing the panels parallel to the undulations is repeated a sufficient number of times until the desired full arc length has been formed in the panels.

In accordance with another embodiment of the present invention, the forming of the curved panel sections is done by carefully stretch forming them over a mandrel having the required radius of curvature. Such a mandrel has a profile corresponding to the profile of the panel, means for grasphing the panel to move it with the rotating mandrel and a firm support for the panel section disposed on the side of the panel opposite from the mandrel to assure an even, wrinkle-free incremental stretch forming of the panel to the exterior configuration of the mandrel.

Next, the panels are shipped to the construction site and there they are sequentially erected. Preferably, this is done in accordance with the present invention by first erecting the wall panels at one end of the building and securing thereto the associated roof panels with the curved panel connectors. As soon as these panels are secured to each other, they become self-supporting and the remaining wall panels and roof panels can be sequentially bolted or otherwise secured to the first erected panels until the full length of the building has been completed. This task involves the simple pick up of panels (manually or with a fork lift, for example), their placement adjacent the previously erected panels so that the respective panel edges overlap, the aligning of the bolt holes and the fastening of each fresh panel to the previously erected panel until the building has been completed. Of course, it is equally within the purview of the present invention to begin the erection of the building at its center, for example, and to add on all succeeding panels to both sides of the center panel to thereby speed up the erection process.

The careful forming of the roof panel center portions and the upper regions of the wall panels (to define the roof-to-wall connector) is necessary to avoid otherwise extensive differential elongations between the inner and the outer undulations being curved. Many conventional forming techniques are inadequate for this task because of their tendencies to simply elongate the outer undulations while compressing and buckling the inner panel undulations. For example, the conventional flow-forming of the sheet by subjecting it to flow-forming forces (e.g. by placing the sheets under a drop hammer) is not normally feasible because the relatively large dimensions of the panels would subject them to acceleration forces which can cause the permanent deformation of portions of the panels not being deformed. The incremental flow-forming or stretch forming approach of the present invention, however, yields excellent results, is relatively inexpensive and quickly performed, and has none of the drawbacks of other forming processes. In this manner, building panels of even the large corrugation sizes mentioned above can be economically made without in any manner compromising the strength of the panels and of the curved portions and, thereby without compromising or endangering the structural integrity of the building.

As is apparent from the preceding, it is of primary importance to the invention to utilize structural corrugated plate both as the supporting and load carrying member for the building and as its enclosure, thereby eliminating the need to provide independent members for both of these functions which must be independently manufactured, erected and secured to each other. Although this places limits on the size and particularly on the width of the building, the present invention also enables the construction of exceedingly wide buildings which cannot be spanned by a single, unsupported roof panel without employing additional building modules. In such instances, the roof is constructed of two spaced apart, corrugated roof panels interconnected by suitably arranged diagonal panel webs. Both of the roof panels are secured to the side wall panels of the building with the above-discussed curved corrugated connector plates. Similarly, curved connector plates may be attached to the roof panel to mount and support building fascias, to attach interior crane carrying beams to the building side walls, or to strengthen the corrugated curved connector plates.

From the preceding summary, it should be apparent that the present invention greatly facilitates the construction of large as well as small industrial type buildings. However, it is not so limited. Its underlying concepts can be equally advantageously employed for residential construction. For such applications corrugated wall and roof panels are assembled in the described manner over a concrete slab, for example, which has the desired plan configuration of the residence. The walls may be suitably insulated and the resulting enclosed interior space can then be subdivided in any desired manner without regard to structural limitations or requirements since the outer shell and particularly also the roof are fully self-supporting. This gives the designer full freedom to lay out the interior space. Since none of the interior walls are load bearing walls, the interior space can further be divided with movable walls and partitions.

DESCRIPTION OF THE PREFERRED EMBODIMENTS

Figure 1:
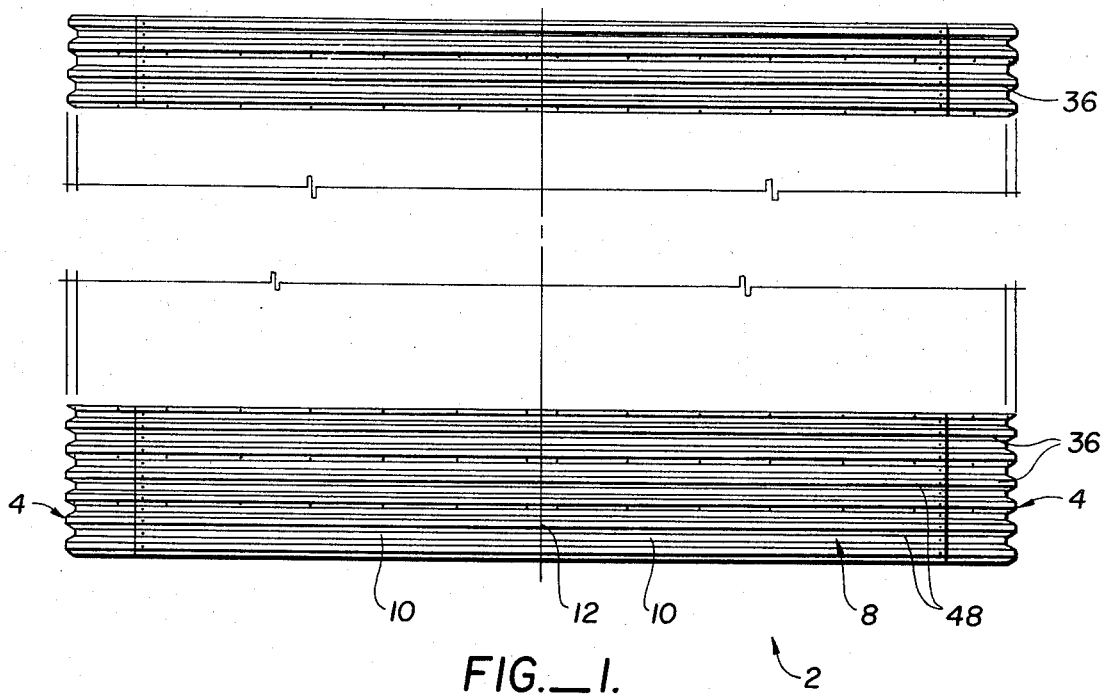
FIG. 1 is a plan view of a building constructed in accordance with the present invention.

Referring first to FIGS. 1–4, an industrial type building 2 constructed in accordance with the present invention generally comprises a pair of parallel, spaced apart buildings side walls 4 that are anchored to foundations 6. A gabled roof 8 defined by two angularly inclined roof sections 10 which meet at a roof crown 12 is joined to and carried by the side walls as is more fully described hereinafter. End walls 14 interconnect respective ends of the side walls and the roof and serve to completely enclose an interior space 16 of the building. The end walls include an access door opening 18 which can be suitably closed by gates (not shown in the drawings).

Figure 2:
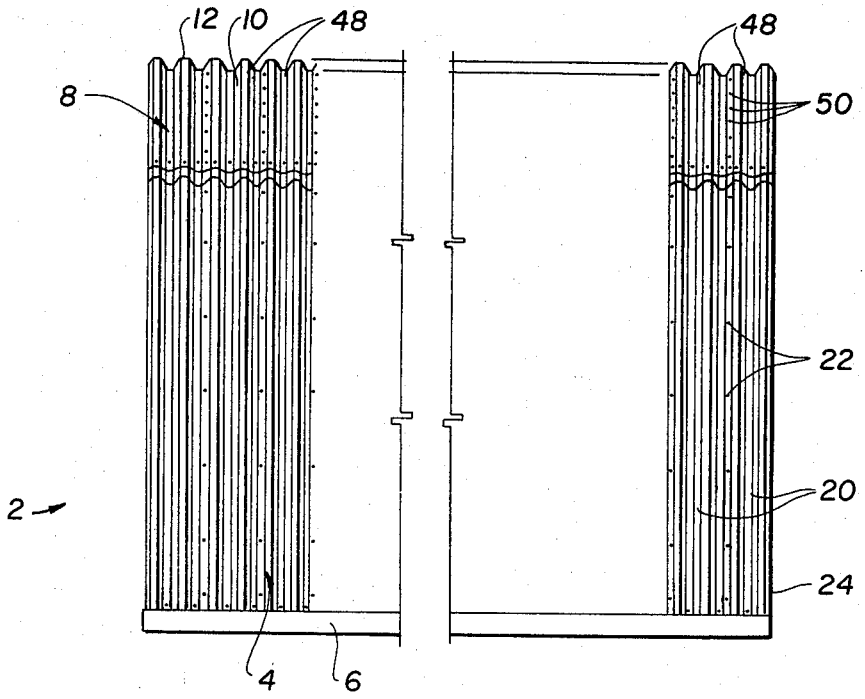
FIG. 2 is a side elevational view of the building shown in FIG. 1.
Figure 6A:
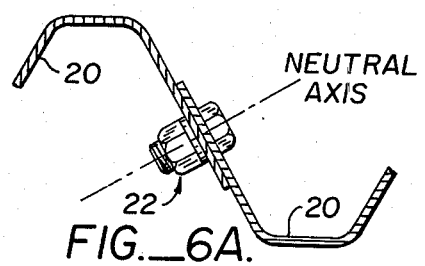
FIG. 6A is a sectional, fragmentary view, is taken on line A—A of FIG. 6 and illustrates the relative positioning of the wall panel connecting bolts on the neutral axis of the corrugations.
Figure 6:
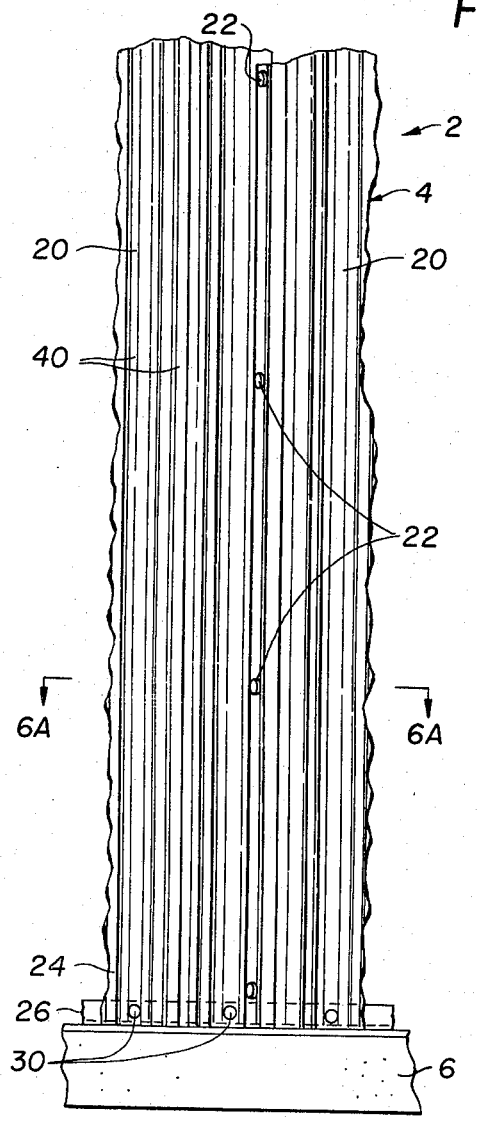
FIG. 6 is an enlarged, fragmentary side elevational view illustrating the manner in which adjacent wall panels are connected to each other and to the foundations.
Figure 7:
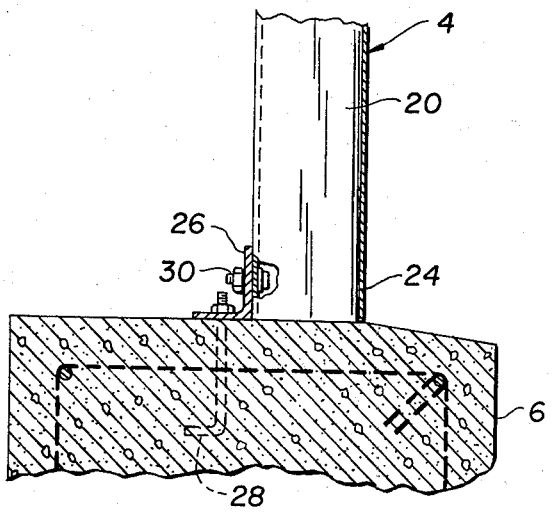
FIG. 7 is a fragmentary, cross-sectional view illustrating the manner in which the building panels are anchored to the foundation.
Figure 4:
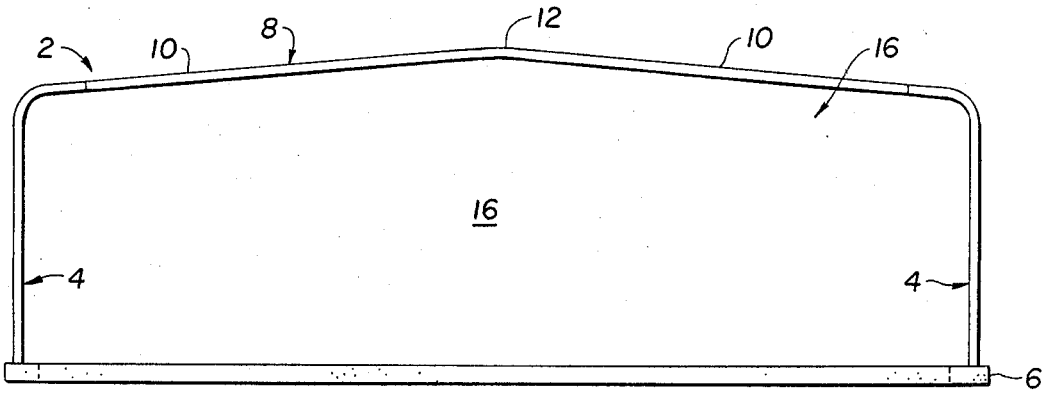
FIG. 4 is an end view similar to FIG. 3 but shows an open building without end walls.

Referring now to FIGS. 1–7, the building is constructed of a multitude of prefabricated panels, preferably corrugated sheet metal panels which have been galvanized or which have received another protective coat or which are constructed of a corrosion resistant material such as copper bearing steel. Thus, each building wall is constructed of a plurality of side by side wall panels 20, preferably constructed of the above-discussed large pitch and depth corrugated sheet metal, the sides of which overlap. Each panel has a length (parallel to the corrugations) which normally substantially exceeds its width, as is best illustrated in FIGS. 2, 6 and 7, and a plurality of matchingly located holes in the overlapping panel sides through which bolts 22 are extended as the panels are erected. Upon the tightening of the bolts adjacent wall panels are firmly secured to each other.

A lower end 24 of the panels can be attached to foundation 6 by providing a longitudinally extending foundation angle 26 which is conventionally attached to the foundation with anchor bolts 28. Additional bolts 30 secure the lower wall panels ends 24 to the foundation angle. It should be noted that for specific applications, the bolts 22, 30 may, of course, be replaced with other fasteners such as rivets, clamps, continuous welds, spot welds and the like.

Figure 21:
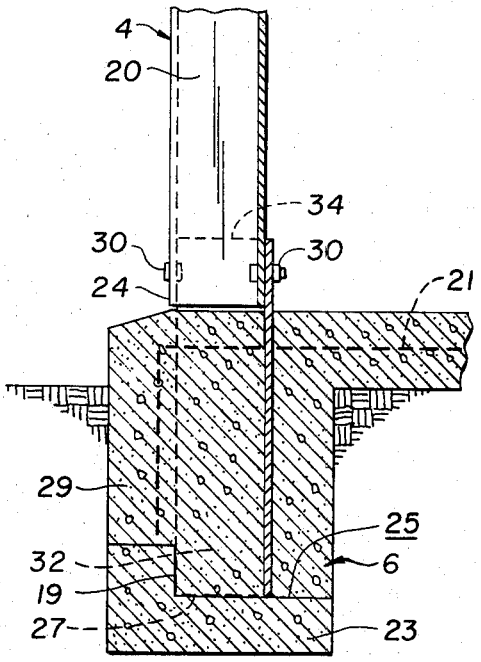
FIG. 21 is a fragmentary, side elevational view which illustrates an alternate method for anchoring the building wall panels to a foundation.

Referring momentarily to FIG. 21, in an alternate construction the wall panels 20 may be prefabricated with an extra length and sunk directly into the foundation 6 when the foundation is being poured with reinforcing rods 21 extending through suitably placed holes (not shown) in the panels. To eliminate the need for maintaining the side wall panels erect before the foundation concrete hardens the extra wall panel length may be supplied by foundation panel sections 32 which have an upper end 34 that protrudes above the foundation and onto which the wall panels 20 are secured as above-described, e.g. with bolts 30. The advantage of this construction is that an intimate connection between the lower wall panel ends 24 and the foundation is obtained. Additionally, the foundation angle 26 shown in FIGS. 5–7 is eliminated, thereby further reducing the obstruction of the interior building space 16.

Still referring to FIG. 21, a preferred method for erecting a building with side wall panels 20 submerged in foundation 6 is to initially pour a foundation base 23 the upper surface 25 of which includes an abutment 19 or which, alternatively, is maintained level. Surface 25 is at an elevation so that a lower edge 27 of side wall panels 20 can rest directly on the base surface. Thereafter the panels are assembled, e.g. secured to each other and the corresponding roof panels (not shown in FIG. 21) are secured to the side wall panels to render the building self-supporting. After the whole building, or a substantial part thereof, has been erected and reinforcing bars 21 have been added as required, the building side walls 4 are mechanically aligned with hydraulic jacks or the like and a remainder 29 of foundation 6 is poured. This method of erecting a building and pouring the foundation greatly speeds up the overall construction since the side wall panels need not be aligned with base angles and bolt holes. The overall mechanical alignment of the building walls is simple and needs no particular accuracy. Thereafter, the cement is poured around the side wall panels and once the concrete has hardened, the building is ready for use.

Referring again to FIGS. 1–7, in a typical building for industrial, e.g. manufacturing use having an interior width of about 50 feet, a side wall height of about 22 feet and any desired length, the wall panels 20 may be constructed of 1/16 to ¼ inch thick corrugated steel plate having a 16 inch pitch and a 5½ inch corrugation depth and a trapezoidal cross-section as is further described below. For such a building, the wall panel connecting bolts 22 are placed at the neutral axis of the corrugations, as shown in FIG. 6A, and they are typically spaced apart about 2 to 4 feet while the base bolts 30 connecting the lower wall panel ends to the foundation angle 26 are typically spaced about 16 inches on center.

Figure 3:
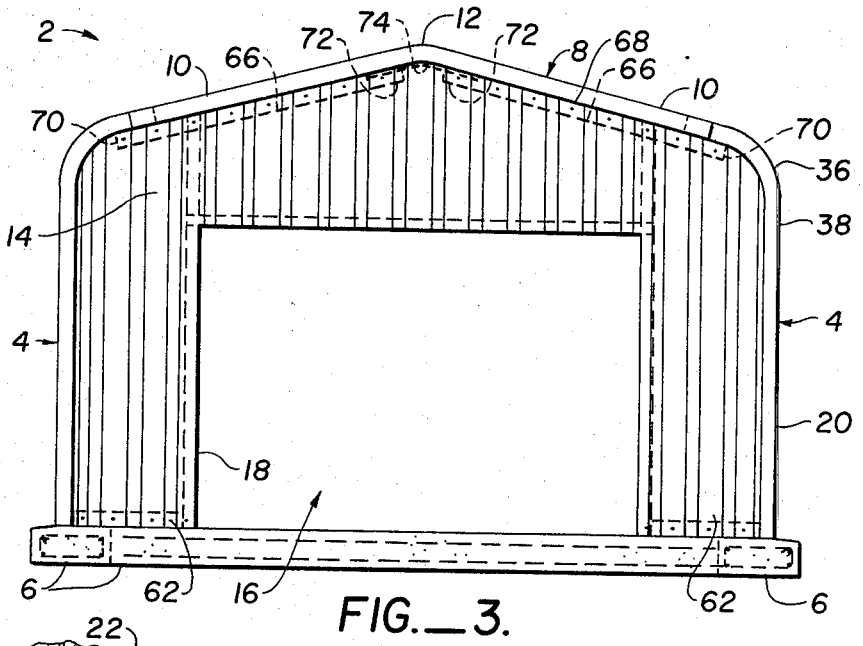
FIG. 3 is an end elevational view of the building shown in FIG. 1.
Figure 5:
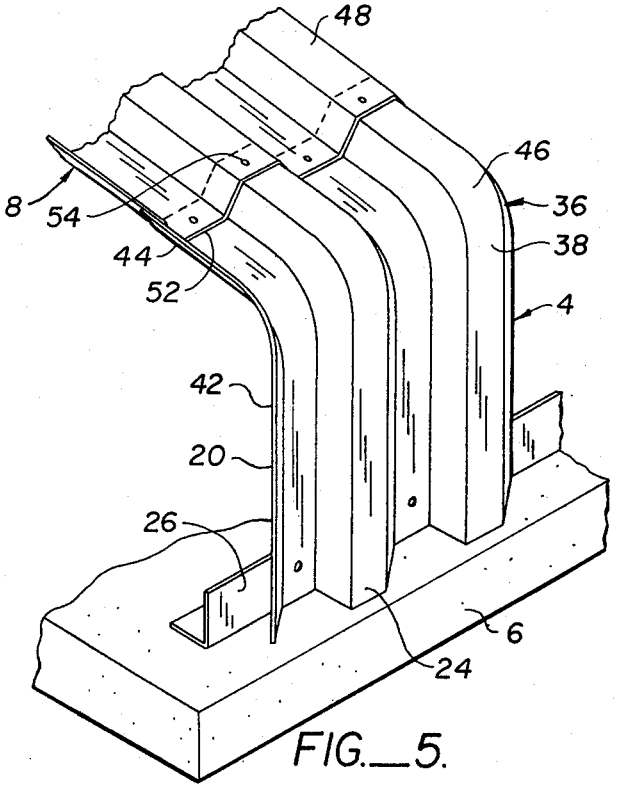
FIG. 5 is a fragmentary perspective view showing the manner in which the roof of the building is connected to the side walls of the building with the wall height being shown relatively shorter than what it actually is.
Figure 8:
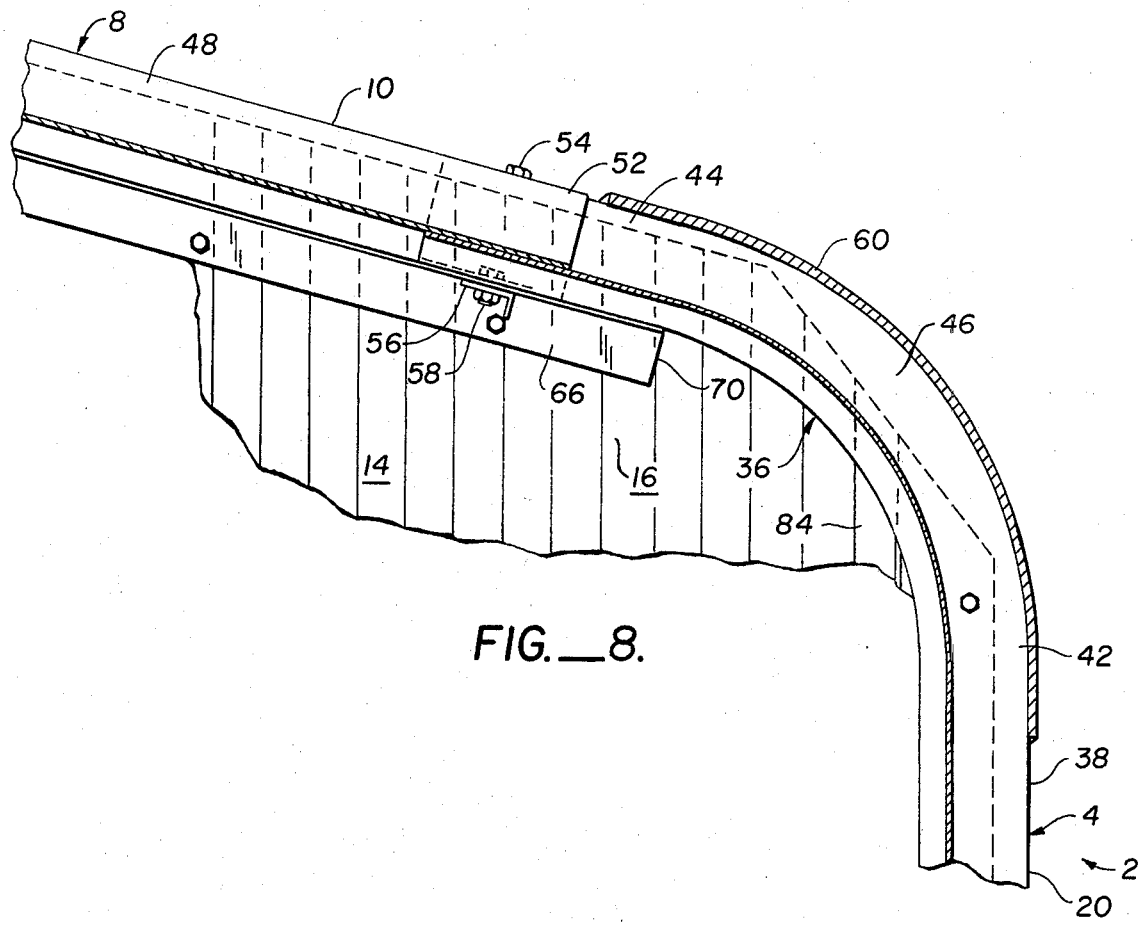
FIG. 8 is an enlarged, fragmentary, end elevational inside view of the building illustrating the detailed construction of the curved connector which connects the upper end of the wall panels to the lateral ends of the roof panels.
Figure 9:
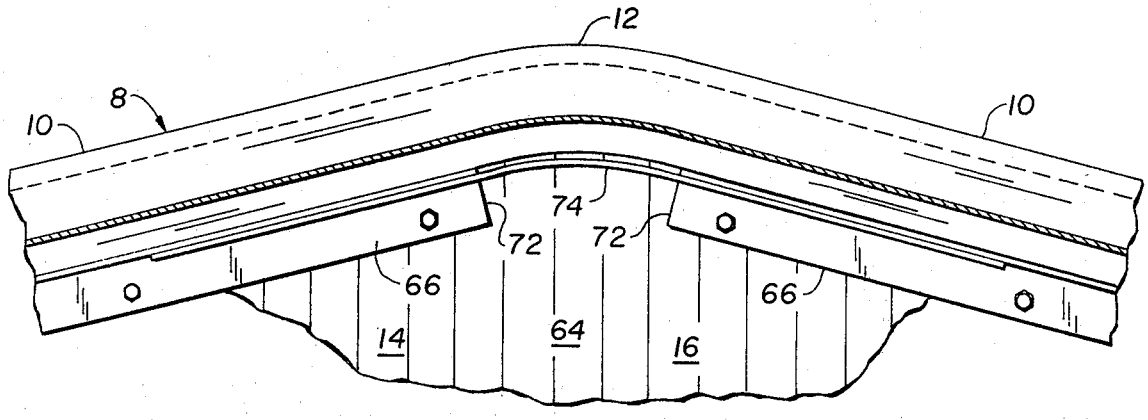
FIG. 9 is a fragmentary, enlarged end elevational inside view of the building, partially in section, illustrating the construction of the center section of a roof panel.

Referring now to FIGS. 3, 5 and 8, a curved connector 36 which is preferably integrally constructed with and projects from an upper end 38 of each wall panel 4 is used for securing roof 8 to the building side wall 4 and provides the structural support for the roof. The connector has the same width and profile as its associated wall panel, e.g. the above-mentioned 16″×5½″ corrugations. The connector is defined by a first, lower section 42 which ties into the upper end 38 of the wall panel, a second, angularly inclined end section 44 (which supports roof 8), and a curved, intermediate section 46 which is integrally constructed with the first and second section and interconnects them. Although the radius of curvature of the intermediate section is not critical, for a building of the above-discussed size, a curvature radius of about 18 to 24 inches has been found to be advantageous both from a manufacturing point of view, as more fully discussed hereinafter, and from a load carrying and aesthetic point of view.

Although it is preferred that connector 36 is integrally constructed with wall panels 20, if desired, it may also be integrally constructed with roof panels 48 or, for that matter, it may be independently constructed and separately secured, e.g. bolted to the upper wall panel ends 38 and the lateral roof panel ends 52. Additionally, if desired the connector may be secured to the roof panel (and/or to the wall panel) with such fastening means as rivets, clamps, welds and the like. Further, for specific application in which extreme loads are encountered, such as in geographic areas in which heavy snow accumulation and/or wind loads can be expected, a tension plate 60 can be secured, e.g. welded to the exterior of connector 36. The tension plate is a flat or corrugated plate that has a radius of curvature which corresponds to the curvature radius of the exterior of the connector.

Referring now to FIGS. 2, 3, 8 and 9, the roof 8 is also constructed of a plurality of side by side roof panels 48 which have the same profile as the wall panels 20 and which preferably also have the same width. Lateral edges of the roof panels overlap and they are secured to each other with a plurality of bolts 50, rivets or the like which, for the above-discussed building, may also have a center spacing of about 2 to 4 feet. Lateral ends 52 of the roof panels overlap and are positioned on top of connector end sections 44 and they are secured thereto with load bearing and load transmitting bolts 54.

Roof crown 12 interconnects the inclined sections 10 of each roof panel. To facilitate the manufacturing of the panels, as is more fully discussed hereinafter, the roof crown is also curved in the direction of the panel corrugations and preferably has the same radius of curvature as the curved connector section 46, e.g. a radius of 18 or 24 inches.

For purposes further described hereinafter, an L-shaped stringer 56 is positioned on the inside of the roof so that it overlies the portion of the roof and of the connector in which the two overlap. The stringer terminates at the building end wall 14 (shown in FIG. 3), has a length equal to the width of two or more wall and roof panels 20, 48, and is secured to the end section 44 and the lateral roof panel ends 52 with a plurality of bolts 58. The purpose of the stringer 56 is to transmit horizontal forces to which end walls 14 may be subjected, such as wind forces, to a plurality of wall panels for transmission to the foundation so that the end walls may be constructed of lighter materials.

Referring now to FIGS. 2, 3, 8 and 9, end wall 14 is constructed of relatively thin material. For the above discussed building having 1/16 to ¼ inch thick side wall panels the end wall may be constructed of 18 ga. sheet metal (having a thickness of 0.047 inch). A lower end 62 of the end wall is anchored to foundation 6 in the same manner in which the building walls 4 are anchored to the foundation. An upper region 64 of the end wall, however, must be supported horizontally due to its light construction to withstand horizontal forces, primarily wind forces but also seismic forces where those are encountered.

For this purpose, a pair of force transmitting angles 66 are attached, e.g. bolted, welded or the like to the end wall adjacent and parallel to its upper edge 68 so that the angles run parallel to the roof line. Upon assembly and erection of the end wall, lateral ends 70 of the angles 66 engage the ends of stringers 56 so that horizontal forces acting against the upper region 64 of the end wall are picked up by the angles and transmitted via the stringers to the side wall panels 20. Although the force transmitting angles 66 need only rest against stringers 56 the two may be secured, e.g. bolted to each other by appropriately located bolts (not shown in the drawing). The latter construction is mandatory in instances in which one end of the building is open and wind forces can act on the other end wall from both sides.

Inner ends 72 of angle 66 are joined to each other by a curved crown plate 74. The crown plate eliminate the need for constructing the force transmitting angles 66 from a continuous length of angle iron and thereafter curving, e.g. bending the center portion of such an angle to further reduce the cost of the building.

Figure 10:
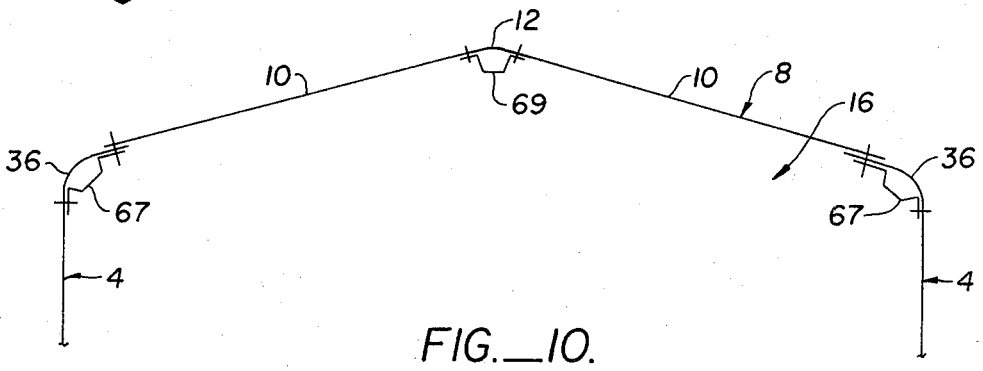
FIG. 10 is a schematic end view of a building constructed in accordance with the present invention and illustrates an alternative embodiment to that shown in FIG. 8 for transmitting horizontal forces acting on the building end walls to the roof and/or side wall panels of the building.

Referring briefly to FIG. 10, the above-discussed stringers 56 may be replaced with generally U-shaped and laterally flanged corner channels 67 and 69 placed on the inside of connectors 36 and of the roof crown 12, respectively. The flanged channels serve several purposes; first they transmit horizontal end wall forces from the building end walls to the building side walls 4, secondly, they serve as a stiffening and reinforcing members for connectors 36 and roof crown 12, and thirdly, the connectors and their relative distribution may at times eliminate the need for the roof shaped force transmitting angles 66 discussed above.

Figure 19:
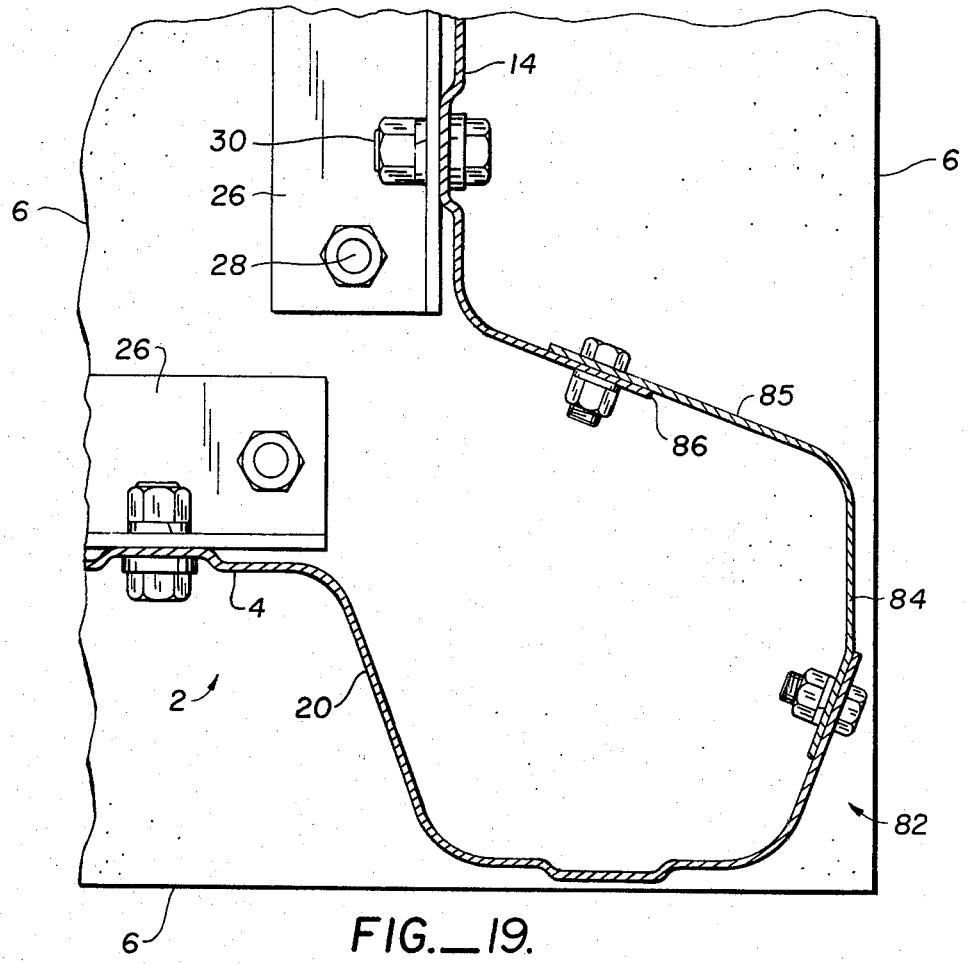
FIG. 19 is a fragmentary plan view illustrating the connection of a load carrying building side wall to the building end wall.

Referring briefly to FIG. 8 and 19, upon the complete erection of a building side wall 4 and of end wall 14 an otherwise unsightly, open building corner 82 is formed. To fully enclose the corner and to effectively interconnect the ends of the side walls and the lateral edges of the end wall a flashing plate 84 having a modified, L-shaped cross section (as shown in FIG. 19) is bolted to the last wall panel 20 and the edge 86 of end wall 14. The flashing plate extends from the ground level, e.g. from the foundation to beneath roof 8 (shown in FIG. 8) and completes the building and the enclosure of the interior space 16.

Flashing plate 84 serves the additional purpose of giving the building even overall dimensions. As will be discussed more fully below, it is presently contemplated to construct the building wall and roof panels 4 and 10, respectively, by corrugating 48 inch wide steel plate into corrugated panels having an overall width of 32 inches, that is 2⅔ feet. Even building widths of, say, 5-foot increments, cannot always be obtained with such standard panels. Therefore, the flashing plate 84 is constructed so that its flange 85 which extends in a transverse direction of the building can be suitably lengthened or shortened so as to give the building a standard overall width.

Figure 20:
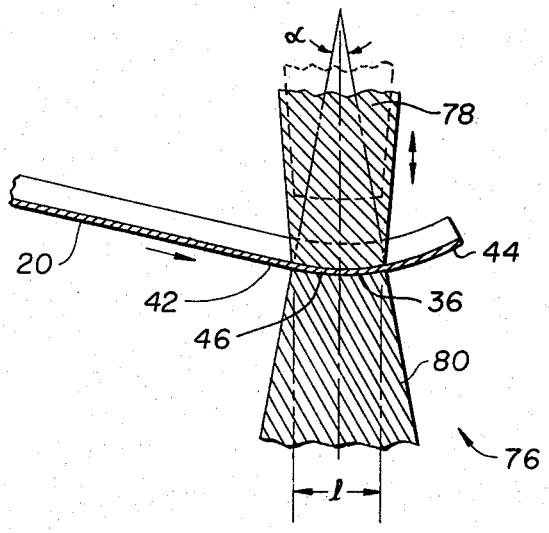
FIG. 20 is a schematic elevational view illustrating the manner in which curved corrugated building panel sections of the present invention are incrementally flow-formed in accordance with the present invention.

Referring to FIG. 20, the above-described building 2 is fabricated, assembled and erected in accordance with the present invention as follows. First, metal of the appropriate thickness is corrugated by feeding sheet metal strips through an appropriately designed corrugator, preferably a corrugating mill (not shown). Either before or after the corrugation operation, the sheet metal is cut to size so that corrugated panels having the desired width and length are formed. For most applications this requires the manufacture of only two panels, one having the desired width and length of all panels 20 and the other having the same width but the necessary length for roof panels 48.

Next, the roof panel crowns 12 and the wall panel connectors 36 are generated. In accordance with one embodiment of the invention, this is done by incrementally flow-forming the affected panel portions under a drop hammer 76 (shown in FIG. 20). Such drop hammers are commercially available from the Chambersburg Engineering Co. of Chambersburg, Pennsylvania, under the trade designation CECOSTAMP.

The drop hammer is fitted with upper and lower dies 78, 80 which have the same profile as the corrugated panels and which have a curvature in the direction of the corrugation which equals the desired curvature of the curved connector section 46 and the curved roof crown 12. By giving both the same curvature radius, only one set of dies 78, 80 is necessary for forming both the connector and the roof crown.

The length of the dies in the direction of the corrugation is only a fraction of the finished arc length of the roof crown 12 and of the curved connector section 46. Frequently, the arc length "l" of dies 78, 80 is only between about 2 to 3 inches, or an arc angle "$\alpha$" of between about 2° to 5°.

The actual forming of a curved panel section, say of a connector 36 integrally constructed with a side wall panel 20 requires that the upper die 78 is first raised (to the position shown in FIG. 20 in dotted lines) and the panel is inserted between the dies so that the end section 44 of the connector fully protrudes from one side of the dies, the righthand side as illustrated in FIG. 20, while an initial, say 2 inch long portion of the curved die section 46 is disposed between the dies. The remainder of the panel protrudes to the left, as seen in FIG. 20.

Next, the dies are forced, e.g. impacted against each other, thereby flow-forming an intial 2 inch long portion of the curved connector section 46. The intensity of the blow exerted by the dies causes the metal to flow into conformity with the (curved) die length without rupturing or tearing. Moreover, the small arc length that is formed during each hammer blow exerts relatively small acceleration forces to the panel portion protruding to the left (as seen in FIG. 20) from the dies so that a buckling of the panel due to such forces is prevented. To further reduce and substantially eliminate all significant acceleration forces it is preferred to position the long length of the panel protruding from the dies (to the left as shown in FIG. 20) at an inclination which approximates the inclination of the panel after an arc length "l" is formed.

Another embodiment of the present invention contemplates to stretch form the corrugated panels to generate the curved portions for the connectors 36 and/or roof panels 10. This stretch forming is incrementally performed by providing a mandrel having an exterior profile which corresponds to the profile of the corrugated sheet. One end of the sheet is securely, e.g. hydraulically clamped to the mandrel and the mandrel is slowly rotated about its axis. Another, travelling but flat support plate, which also has a profile corresponding to the profile of the corrugated sheet, is placed on the sides of the sheet opposite from the mandrel and moves with the sheet as the mandrel is rotated so that the flat portion of the sheet is maintained flat and fully supported to thereby prevent the formation of wrinkles in the metal as it is being stretch formed.

The structural portion of the building is now ready for erection. It should be noted that this portion of the building consists of only two main elements or modules, to wit the wall panels 20 with the integrally constructed, structural connectors 36 and the roof panels 48. At the building site the panels are assembled one by one, preferably by first erecting the wall panels and the associated roof panels at one end of the building, bolting them to the foundation angle 26 (or to the foundation panel sections 32 as shown in FIG. 21) or by resting the lower wall panel edges 27 on foundation base 23 and against foundation abutment 19. Thereafter, the other wall and roof panels are positioned in succession and the overlapping portions of adjacent panels are secured to each other with bolts 22 as best shown in FIG. 6A. Also secured to the underside of the roof panels are stringers 56 (FIG. 8) or flanged channels 67, 69 (FIG. 10).

The building is now ready to receive end walls 14 which is preferably also constructed of relatively narrow, individual panel sections. Since the end wall is not a load bearing wall, and since the stringers or flanged channels transmit horizontal wind forces and the like from the upper region of the end walls directly to the side walls while the lower end wall portion 62 is secured to foundation 6, the end wall panels can be constructed of the thin material above discussed.

Figure 22:
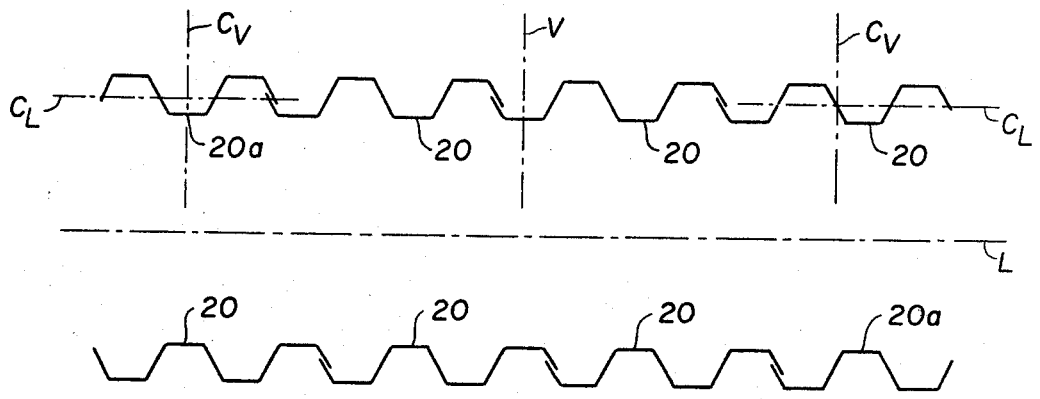
FIG. 22 is a schematic plan view of a preferred arrangement of the corrugated wall panels.

Referring now to FIGS. 1-3, 22 and 23, the dimensioning of the wall panels 20 and the roof panels 10, both in terms of their overall width and in terms of the corrugation pitch, width and depth is important to minimize the number of different panels required to erect a given building, to maximize the strength and coverage of a panel corrugated from flat steel plate of a given width, e.g. 48 inches, and to assure the formation of snug, nesting joints between the panels, particularly between the wall panels and the roof panels. As was briefly mentioned above, to render the wall panels 20, which includes curved connectors 36, interchangeable between both sides of the building, that is to eliminate the need for lefthand and righthand panels, the corrugations of the panel are symmetric about perpendicular, vertical center lines $C_V$ and $C_L$ as is shown in FIG. 22.

Furthermore, the corrugations are selected so that the lateral edges of each panel define sloped corrugation sides so that the bolts which interconnect the panels can be placed on the neutral axis (as shown in FIG. 6A).

When the panels are so constructed, it is necessary to supply for each building wall one end panel **20*a* which is not symmetrical in the sense in which panels 20 are symmetrical and in which the lateral edges are defined by non-parallel, sloping corrugation sides, also as illustrated in the FIG. 22**. Accordingly, each end panel is asymmetric about one of the two perpendicular center lines, that is longitudinal center line $C_L$.

An end panel **20*a* of each wall is installed at opposite building ends so that each end of each building wall terminates with an inwardly sloping corrugation side to which the flashing plate 84 (FIG. 19**) is attached. This renders each building wall symmetric about vertical wall center line V while each building wall is symmetric about the longitudinal building center L.

In a practical embodiment the wall and roof panels 20, 10 are corrugated from 48 inch wide steel plate. The corrugation pitch "P" and depth "D" are 16" and 5½", respectively, so that the panels 20, 10 have an overall width of 32 inches (two complete corrugations) while the end panels **20*a*** have a width of 24 inches. This dimensioning of the corrugations provides the above discussed optimization of area coverage and strength.

Figure 23:
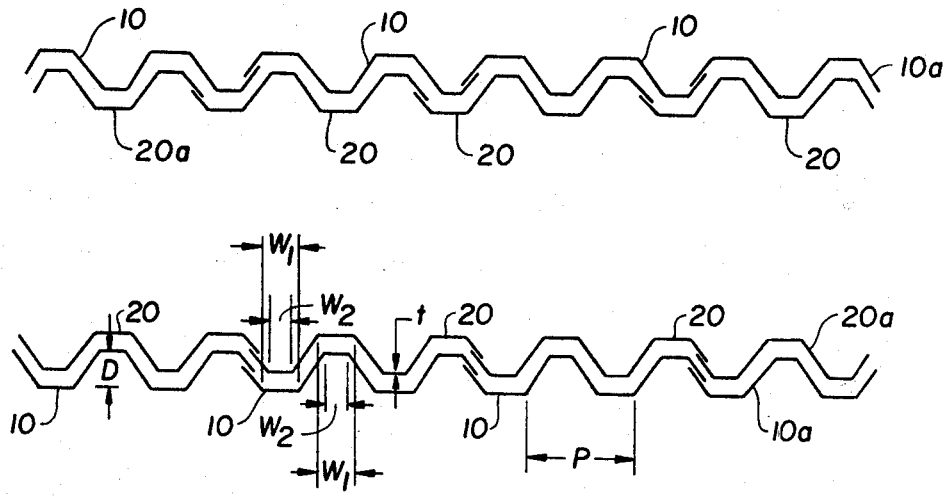
FIG. 23 is a schematic diagram similar to that of FIG. 22 and it shows the arrangement and relative dimensioning of both the wall and the roof panels.

Referring now specifically to FIG. 23, there is schematically illustrated the overlap between the inwardly and upwardly sloping end of curved connectors, identified with the wall panel reference numberals 20, **20*a* and roof panels 10. In order to match the overall length of the roof to the wall length as above discussed, it is necessary to provide one roof end panel 10*a* which has the same width as wall end panel 20*a***.

Additionally, to effect a proper seating between the curved connector corrugations and the roof panel corrugations in instances in which the panels are constructed of relatively heavy materials having a thickness of say more than 14 or 16 gauge, it is necessary that the corrugation peak and valley widths "W1" and "W2" alternatingly differ. In the presently preferred embodiment of the invention the difference between W1 and W2 is one plate thickness "t" so that the corrugation peak and valley base widths of each panel alternatingly differ by the material thickness of the panel. As a practical approximation the base widths may, for example, differ by 3/16 inch, which can accommodate the nesting of panels having material thicknesses of ¼ inch, ¼ inch to 14 gauge, or 14 gauge to 14 gauge, for example. The corrugation pitch "P" and depth "D", however, remain unchanged.

The panels can be constructed so that they have the alternating base widths throughout their lengths. In such a case the base width differences can be rolled or corrugated into the initially flat sheet. Alternatively, the original sheet can be conventionally corrugated so that all corrugations have like widths. Thereafter, the overlapping ends of the first corrugated panels can be inserted into expansion dies and placed in a suitable press, such as the above-referenced CECOSTAMP, to provide the overlapping panel ends with the differing, alternating base widths to assure the proper seating of the panels.

Figure 14:
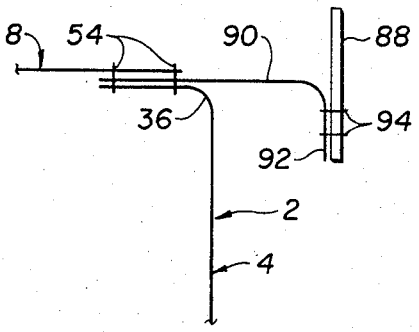
FIGS. 14 and 15 are schematic, end elevational views, in section and illustrate alternative embodiments for fitting the building with fascias by using corrugated plate members curved similarly to the manner in which the joints between the building walls and the roof panels are curved.
Figure 15:
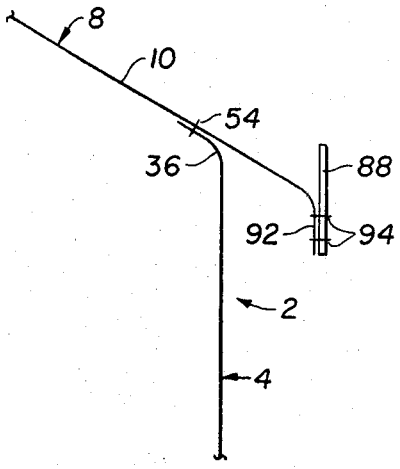

Referring to FIGS. 14 and 15, to improve the aesthetic appearance of the exterior of building 2 fascias 88 may be attached to the building. The fascias may be constructed of any material which provides the desired architectural effect and they are secured to overhanging members 90 which are constructed of the same corrugated plate of which the building side walls 4 and the building roof 8 are constructed. In the embodiment shown in FIG. 14, in which the roof is horizontal, the overhanging member is L-shaped and secured to the roof and the structural wall-to-roof panel connector 36 with the earlier discussed bolts 54. The fascia is conventionally bolted to the downwardly extending leg 92 of the overhanging member as with bolts 94.

In the embodiment shown in FIG. 15, in which the building has a downwardly sloping roof 8, the overhanging member may be integrally constructed with roof panels 10 by curving the lateral end of the panels to define the downwardly extending leg 92 to which the fascia 88 is attached. Alternatively, a separate overhanging member constructed generally as shown in FIG. 14 may, of course, be provided. In both instances, however, the corrugated plate overhanging member is structurally similar to structural wall-to-roof connectors 36, including the above-discussed curved, corrugated plate portion between the horizontal (or inclined) portion of the overhanging member and the downwardly depending leg 92.

Figure 26:
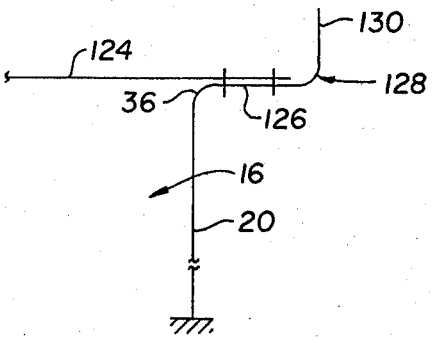
FIG. 26 is a schematic, fragmentary end view of a building having a flat roof and a fascia that is attached to an outwardly curved structural connector for the roof.

Referring to FIG. 26, in an alternative embodiment of the invention, one particularly adapted for use in connection with flat roofs 124 constructed of corrugated plate, the structural, corrugated connector 36 may be integrally constructed with wall panels 20 and arranged so that the connector curves outwardly, away from interior building space 16. The connector is curved through an arc of 90° and includes a horizontal portion 126 to which the flat roof 124 is bolted or otherwise secured. To enhance the appearance of the building, a fascia 128 may be provided which may be integrally constructed with the connector, or which may be secured thereto with bolts or the like. The fascia terminates in a vertically disposed panel 130.

Figure 27:
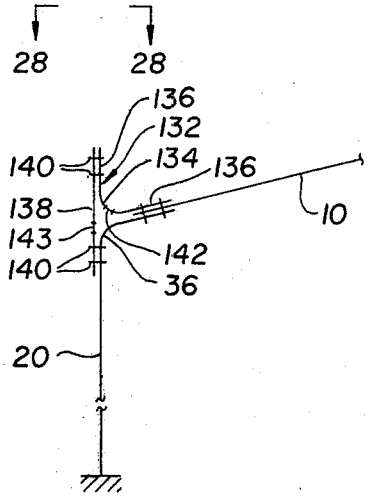
FIG. 27 is a schematic end view of an alternative structural roof-to-wall connector constructed in accordance with the present invention having improved strength and facilitating the mounting of building fascias.
Figure 28:
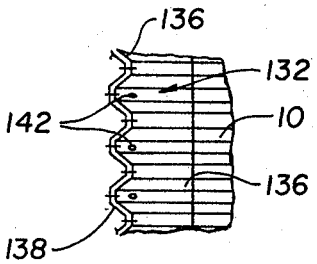
FIG. 28 is a fragmentary plan view and is taken on line 28—28 of FIG. 27.
Figure 29:
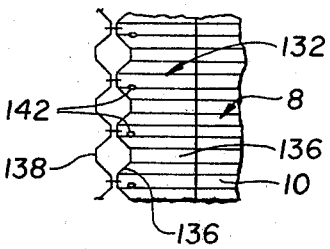
FIG. 29 is a fragmentary plan view similar to FIG. 28 but illustrates an alternative embodiment of the invention.

Referring now to FIGS. 27–29, in yet another embodiment of the invention, wall panels 20, roof panels 10 and the structural connectors 36 are constructed and assembled as earlier described. To strengthen the wall-to-roof connection, a second, structural connector 132 is placed on top of the roof, is similarly constructed to connector 36 and, consequently, includes a curved section 134 terminating in legs 136 which are angularly inclined with respect to each other so that one of the legs is substantially vertical when the second connector is secured to the remainder of the building, e.g. the roof and the first connector 36 as is best illustrated in FIG. 27. A straight fascia plate 138 is placed over the exterior sides of connectors 36 and 132 and is conventionally secured thereto as with a plurality of bolts 140.

It will be observed that the second connector in combination with the fascia plate, which is also constructed of corrugated plate, significantly strenghtens the wall-to-roof connection. To provide for drainage, suitably located drainage holes 142 are provided in the corrugation valleys of the upper connector 132 so that water accumulating on the building roof can be drained therefrom past the trough formed by the upper connectors. In instances, in which the fascia plate 138 nests with the corrugations of wall panels 20 (as shown in FIG. 27) secondary drainage openings 143 are formed in the fascia plate. When the corrugations of the fascia plate are arranged to oppose the building wall panel corrugations (as shown in FIG. 29) the provision of the secondary drainage openings is not necessary because water can run down the (open) side wall panel corrugations.

Figure 11:
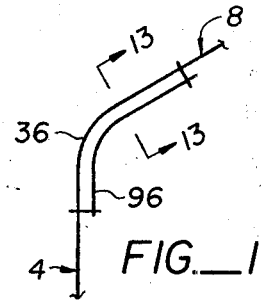
FIG. 11 is a schematic, fragmentary, side elevational view, similar to FIG. 8, and illustrates an alternative method for strengthening the joint between the roof and the building side walls for applications in which the roof is subjected to relatively large forces.
Figure 12:
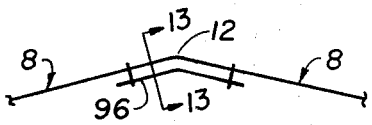
FIG. 12 is a schematic, fragmentary, end elevational view similar to FIG. 9 and illustrates an alternative embodiment of the present invention for strengthening the roof crown.
Figure 13:
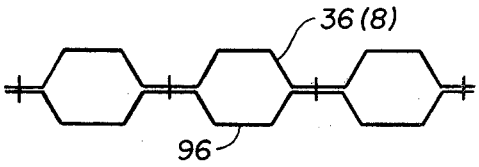
FIG. 13 is a fragmentary, side elevational view, in section, and is taken on lines 13—13 of FIGS. 11 and 12.

Referring to FIGS. 11–13, in instances in which the curved portions of the structural wall-to-roof connectors 36 and of the roof panel crowns 12 require reinforcement, short complementary curved gusset plates 96 constructed of the same corrugated plate as the connectors and the roof panels may be suitably attached, e.g. bolted, or riveted, or welded to the connectors and the roof panels in the illustrated manner. These gusset plates both strengthen and rigidify the structure when the roof span (or building width) is relatively large.

Figure 18:
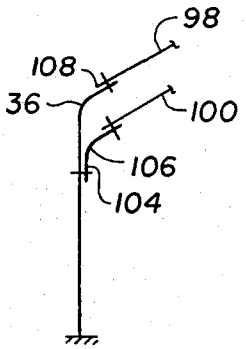
FIG. 18 is a fragmentary end elevational view, in section, and shows an alternative method for connecting the roof illustrated in FIG. 17 to the building side walls.
Figure 17:
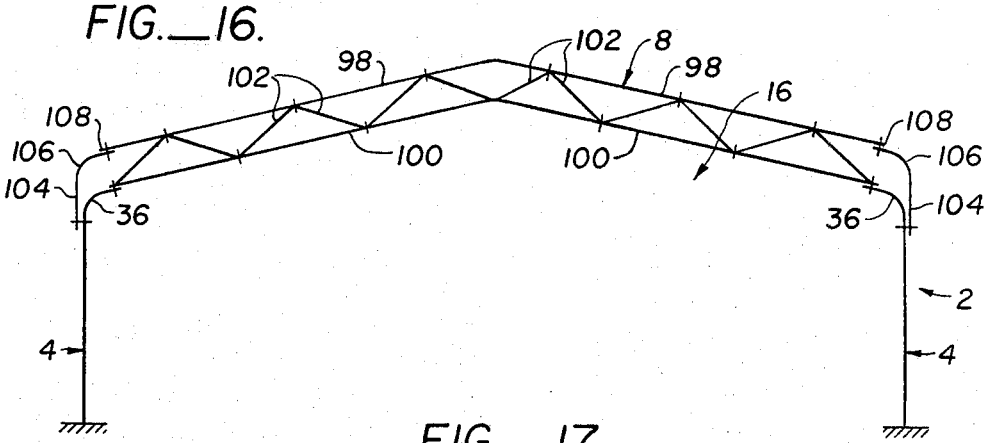
FIG. 17 is a schematic, end elevational view of a building constructed in accordance with the present invention and having a roof constructed of parallel, spaced apart corrugated roof panels connected to the building side wall panels with curved, corrugated connectors constructed in accordance with the present invention.

Referring now to FIGS. 17 and 18, in instances in which the roof span is so large that even gusset plates 96 provide insufficient strength, roof 8 can be constructed of two parallel, vertically spaced apart corrugated roof panel members 98, 100 which are interconnected by corrugated diagonals 102. While the connection of lower roof member 100 to building side walls 4 is as above described, that is with curved, corrugated structural connector 36, a second, separate structural connector 104 having a curved section 106 similar to the curved section 46 of connector 36 is suitably attached, e.g. bolted, riveted, welded or the like to the upper end of building side wall 4 and the lateral ends 108 of upper roof panel members 98. To equalize the loading of the upper and lower roof panel members 98, 100 diagonals 102 may be continuous, web-like diagonals which run over the full length of the building or intermittently over a substantial portion thereof.

In the embodiment of the invention as shown in FIG. 18 the positioning of the two corrugated, curved connectors 36, 106 is reversed from that shown in FIG. 17. In all other respects the roof illustrated in FIG. 8 is identical to the one shown in FIG. 17. It will be appreciated that in both instances, very large roof spans can be attained without the need for supporting columns, rafters beams and the like.

Figure 16:
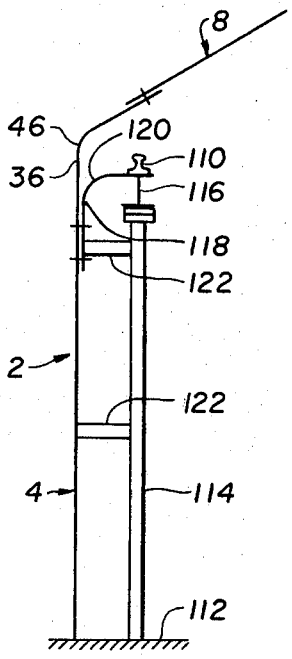
FIG. 16 is a fragmentary, end elevational view of a building constructed in accordance with the present invention including an interior crane support employing curved corrugated plate connectors constructed in accordance with the present invention.

Referring now to FIG. 16, a building 2 constructed as shown in FIGS. 1–4 and described above is provided with a crane rail 110 supported above ground 112 by intermittent columns 114 which are spaced a sufficient distance from building side walls 4 to permit the travelling of the crane. As is conventional, a continuous I-beam 116 rests on top of the columns and supports the rail. The upper flange of the I-beams is rigidified and tied to the adjacent building side walls 4 with L-shaped, corrugated plate connectors 118 which have a curved portion 120 shaped and formed similar to the curved section 46 of connectors 36 described above. The connectors 118 and 122 enable the building walls to firmly support the crane I-beams and columns. For instances in which the height of the crane rail support columns may cause a buckling of the column suitable stiffeners 122 may be placed between the columns and the building wall 4 at selected points between ground 112 and the corrugated connectors 118.

Figure 24:
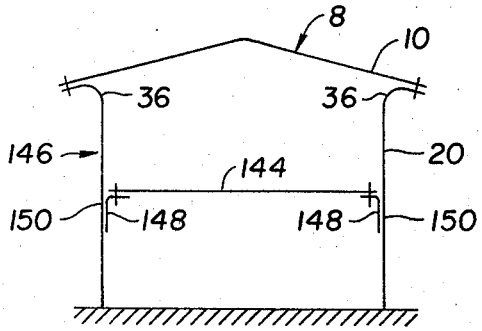
FIG. 24 is a schematic cross-sectional view of a multistory building employing the structural connectors of the present invention for supporting intermediate building floors.
Figure 25:
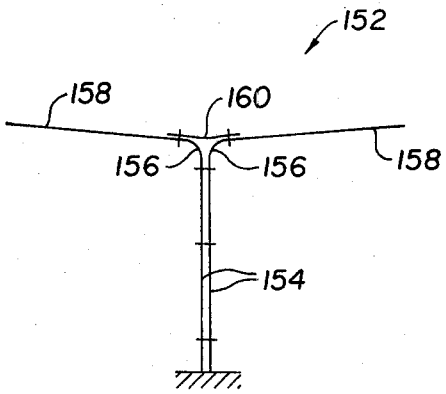
FIG. 25 is a schematic end view of a covered shelter constructed in accordance with the present invention.

Referring to FIGS. 24 and 25, the curved structural connectors described above can be advantageously employed in a variety of other applications. For example, they can be utilized for supporting a floor 144 in a multi-story building or residence 146 by securing, e.g. bolting opposing structural floor connectors 148 to intermediate portions 150 of wall panels 20. In a preferred embodiment of the invention, floor 144 is constructed of the same highstrength corrugated material discussed above. The upper end of the wall panel receives the structural roof connectors 36 which support a gabled roof 8 defined by the above-described roof panel 10. In the illustrated embodiment, the roof connectors face outwardly for a particularly pleasing architectural appearance of the building. Of course, they may be positioned to face inwardly as described above.

In FIG. 25 there is shown a shelter 152 for use at bus or train stations and the like which is constructed of a plurality of upright wall panels 154, to which are joined curved structural connectors 156 all of which are constructed of the earlier described corrugated plate of the present invention. Joined to the connectors are cantilevered roof sections 158 and a tie-plate 160 rigidifies the structure.

From the foregoing description of the invention, its many advantages and, in particular, the simplicity of the building, its fabrication and erection, the resulting cost savings should be apparent. These cost advantages are combined with the highest degree of structural integrity of the building and an enclosed building space that is unobstructed by such structural members as interior columns, beams, trusses, girders, etc. and therefore, is fully usable.

I claim:

1. A building including a plurality of drainage openings in the curved portions of the member to facilitate the drainage of water from the roof.

2. A low cost building erected at a construction site by assembling prefabricated building components comprising in combination at least two substantially parallel, spaced apart side walls, each side wall being defined by a plurality of substantially aligned and interconnected wall panels, each panel comprising an undulated sheet, and means for securing to each other the adjacent sheets; a curved section for each side wall panel, the section being curved towards the other side wall through an arc of no more than about 90°, the curved section including the same undulations as the associated panel and being attached thereto, whereby the curved section defines an upper, load bearing connection for a roof to be placed onto the side walls; means securing the wall panels to a building foundation; plurality of roof panels each defined by a pair of inclined roof sections placed on top of the side walls, each roof panel forming a longitudinally extending center portion of the roof and having undulations complementary to and in alignment with the wall panel undulations, the roof panel undulations nesting with the undulations of the curved sections so that the roof panels are carried by the curved sections and the curved sections support the roof panels; at least one building end wall defined by a relatively thin sheet interconnecting the building walls and an end of the roof; means for transferring at least a part of a generally horizontally acting force from the end wall to the roof panels for transmission of such force to a plurality of building wall panels, the transferring means including a generally horizontally oriented beam disposed adjacent the curved sections and secured to a plurality of at least one of the roof panels and the wall panels; a horizontal force pick up beam secured to the end wall adjacent an upper region thereof, the pick up beam being attached to the horizontal beam for the transmission of the horizontally acting force to the latter; and being angularly inclined and generally disposed parallel to the inclined roof panel sections, the pick up beam further being defined by at least two straight pick up beam segments which extend from the horizontal beams towards the roof center portion, and a plate member shaped complementary to the shape of the roof center portion and having ends connected to adjacent ends of the straight pick up beam segments; whereby the horizontal force is transferred by the horizontal beam to a plurality of building wall panels and hence to the building foundation.

3. A low cost building erected at a construction site by assembling prefabricated building compounds into at least two opposite, parallel, longitudinally extending side walls and a roof interconnecting upper portions of the side walls, the building comprising in combination: a plurality of wall panels for each side wall, the wall panels being constructed of corrugated sheet having parallel, vertically oriented corrugations, at least one first wall panel for each side wall being symmetric about a perpendicular pair of vertical center lines; at least one second wall panel of each side wall being asymmetric about at least one vertical center line for such second panel, such second panel being further dimensioned and shaped so that a longitudinal end of each side wall is symmetric with respect to a vertical center line of the building oriented perpendicular to the side wall, the side walls being further symmetric about a vertical longitudinal center line of the building; the number of first wall panels in each side wall being greater than the number of second wall panels in each side wall; each of said second wall panel being disposed at an opposite end of the side walls; a plurality of first and second roof panels constructed of corrugated plate having corrugations dimensioned to correspond to and aligned with the corrugations of the wall panels, the first roof panels having a relative symmetry of their corrugations and corrugation dimensions which coincide with the symmetry and dimensions of the first wall panels; there being further a number of second roof panels which corresponds to the number of second wall panels, the second roof panels having a relative asymmetry of their corrugations and corrugation dimensions which coincide with the asymmetry and dimensions of the second wall panels; and connection means connecting the roof panels to the upper portions of the wall panels; whereby the wall panels in combination with the connections means can be interchangeably used for either side wall without the need for lefthand and righthand wall panels.

4. A building according to claim 3 wherein the first wall panels and the first roof panels are corrugated from flat sheet having a flat width of about 48 inches, the corrugated first wall panels and roof panels having an overall width of approximately 32 inches.

5. A building according to claim 4 wherein the first wall panel and the first roof panel each have a corrugation depth of about 5½ inches.

6. A building according to claim 3 wherein the connection means is defined by an upper section of each wall panel, the upper section being curved towards the other side wall through an arc of no more than about 90°, the curved section including the same corrugations as the remainder of the panels, whereby the curved section defines an upper, load bearing connection of the roof panels to the wall panels; and means for securing the roof panels to the curved sections.

7. A building according to claim 6 wherein the corrugations of the panels define alternating corrugation peaks and corrugation troughs having a substantially trapezoidal cross-section, and wherein the width of the alternating peaks and troughs is different.

8. A building according to claim 7 wherein the width of one of the alternating peaks and troughs differs from the width of the other one by about one material thickness of the corrugated panels.

9. A building according to claim 8 wherein the corrugations of the curved sections and to the roof panels nest, the corrugations being arranged so that each relatively narrower corrugation peak of one of the curved section and the roof panel is nested within a relatively wider corrugation trough of the other one of the curved section and the roof panel.

10. A building according to claim 3 wherein each wall panel and each roof panel terminates in a sloped web portion intermediate peaks and troughs of the panel corrugations, wherein the web portions of adjacent panels overlap, and including fastening means securing the overlapping webs of adjacent panels to each other.

11. A building according to claim 10 wherein the fastening means is disposed in a neutral axis of the corrugations about midway between the adjoining peak and trough of the corrugations.

12. A partially prefabricated, relatively low cost building comprising a pair of spaced apart, substantially parallel, longitudinally extending upright walls constructed of currugated metal plate, the walls defining substantially the only vertically oriented load supporting structure of the building; a load carrying building roof constructed of corrugated plate having corrugations corresponding to and aligned with corrugations of the walls; connector means securing an upper portion of each wall with an adjacent lateral edge of the roof for transmitting forces between the roof and the walls; an elongated building fascia extending over at least a portion of the length of the building; and fascia mounting means positioning the fascia above ground and laterally spaced from the building, the fascia mounting means including a mounting member constructed of a section of corrugated plate having a first, substantially vertically oriented portion spaced laterally of the building wall, a second portion angularly inclined relative to the first portion, and a third, intermediate portion defined by a continuous curvature of the corrugated plate interconnecting and integrally constructed with the first portion and with the second portion, means for securing the fascia to the first portion, and means for securing the second portion to the building roof.

13. A partially prefabricated, relatively low cost building comprising a pair of spaced apart, substantially parallel, longitudinally extending upright walls constructed of corrugated metal plate, the walls defining substantially the only vertically oriented load supporting structure of the building; a load carrying building roof constructed of corrugated plate having corrugations corresponding to and aligned with corrugations of the walls; connector means securing an upper portion of each wall with an adjacent lateral edge of the roof for transmitting forces between the roof and the walls; a generally trough-shaped member constructed of corrugated plate having corrugations complementary to the corrugations of the walls, the corrugations running perpendicular to a trough defined by the member, the member including first and second legs and a portion interconnecting the legs; means securing one of the legs to at least one of the upright walls and the roof so that the other leg is in substantial alignment with the upright wall, the legs having a relative angular inclination so that the other leg is vertically oriented; a fascia plate constructed of corrugated plate having corrugations complementary to the corrugations of the walls, disposed exteriorly of the upright wall and the other leg and extending over a portion of at least each of them; and means for securing the fascia plate to the member and the other leg to thereby strengthen the wall-to-roof connection.

* * * * *